US005251231A

United States Patent [19]

Croker et al.

[11] Patent Number: 5,251,231

[45] Date of Patent: Oct. 5, 1993

[54] VACUUM FURNACE

[75] Inventors: Michael N. Croker, Huntingdon; Michael G. Ellis, St. Ives, both of England

[73] Assignee: Ipsen Industries International GmbH, Fed. Rep. of Germany

[21] Appl. No.: 777,338

[22] PCT Filed: Mar. 29, 1990

[86] PCT No.: PCT/GB90/00468

§ 371 Date: Nov. 26, 1991

§ 102(e) Date: Nov. 26, 1991

[87] PCT Pub. No.: WO90/12266

PCT Pub. Date: Oct. 18, 1990

[30] Foreign Application Priority Data

Apr. 10, 1989 [GB] United Kingdom ..... 8907994

[51] Int. Cl.[5] ..... H05B 3/10

[52] U.S. Cl. ..... 373/109; 373/111; 373/117; 373/128; 432/121; 432/253

[58] Field of Search ..... 373/109, 110, 111, 112, 373/117, 128, 130; 432/253, 121, 258, 153; 219/390

[56] References Cited

U.S. PATENT DOCUMENTS

| | | | |
|---|---|---|---|
| 2,678,958 | 5/1954 | Hintenberger | 373/111 |
| 3,726,984 | 4/1973 | Barbier et al. | 373/128 |
| 3,995,101 | 11/1976 | Isaksson | 373/111 |
| 4,103,099 | 7/1978 | Allsopp | 373/110 |
| 4,347,431 | 8/1982 | Pearce et al. | 373/109 |
| 4,416,623 | 11/1983 | Takahashi | 373/111 |

FOREIGN PATENT DOCUMENTS

| | | |
|---|---|---|
| 1276685 | 6/1972 | United Kingdom . |
| 1357580 | 6/1974 | United Kingdom . |

*Primary Examiner*—Bruce A. Reynolds
*Assistant Examiner*—Tu Hoang
*Attorney, Agent, or Firm*—Andrus, Sceales, Starke & Sawall

[57] ABSTRACT

An electrically heated vacuum furnace has a plurality of heating elements (13) distributed in an array extending within the furnace. This allows accurate control of the application of radiant heat energy from the elements (13) of the array to articles (10) within the furnace. The elements (13) are preferably disposed spaced apart across the width of the furnace.

8 Claims, 4 Drawing Sheets

VACUUM FURNACE

BACKGROUND OF THE INVENTION

1. Field of the Invention

The present invention relates to vacuum furnaces and, more particularly, to the arrangement of electrical heating elements in such a furnace.

2. Description of the Related Art

Conventionally, electrical heating elements are disposed in such furnaces closely adjacent to the walls of the furnace, the elements comprising either sinuously wound elongate resistive elements, or pad-like sintered resistive elements arranged around the inner periphery of the furnace. Vacuum furnaces have a pressure vessel inside which are arranged insulating elements to minimise heat transfer to the walls of the pressure vessel in order to protect the integrity of the vacuum under which the vessel operates in use.

However, when there are multiple workpieces being treated in the furnace, unless they are all positioned equidistantly from the heating elements, non-uniform heat treatment of the load may occur. Furthermore, masking of the radiated heat applied to particular workpieces can also occur, resulting in insufficient heat treatment thereof.

Additionally, the application of differential heating to certain types of workpieces is difficult to achieve in a satisfactory manner.

SUMMARY OF THE INVENTION

In order to overcome these problems therefore, according to the present invention there is provided an electrically heated vacuum furnace having a plurality of heating elements distributed in an array extending within the furnace, whereby the application of radiant heat energy from the elements of the array to articles within the furnace can be accurately controlled. Additionally, the furnace may include a plurality of shield sections adjustably disposed within the furnace in shielding relationship to selected parts of articles to be treated in the furnace, whereby differential heating of portions of the articles can be achieved. Alternatively, the furnace may include a plurality of shield sections adjustably disposed within the furnace in shielding relationship to selected ones of plural layers of components, whereby the articles in different layers in the furnace can still be heated and cooled uniformly.

A further advantage of the invention is that a reduction in temperature of the heating elements in comparison with known techniques may be achieved, by spreading the sources of heat radiation throughout the furnace rather than locating them solely around the periphery. The technique also obviates the need for complex and costly gas circulation systems, which are needed to improve heat-up times and temperature uniformities in the low temperature (black radiation) ranges, by enabling close spacing of the workpieces from the heating elements.

BRIEF DESCRIPTION OF THE DRAWING

Two examples of a furnace constructed in accordance with the present invention will now be described with reference to the accompanying drawings in which.

DESCRIPTION OF THE PREFERRED EMBODIMENTS

Figure 1:
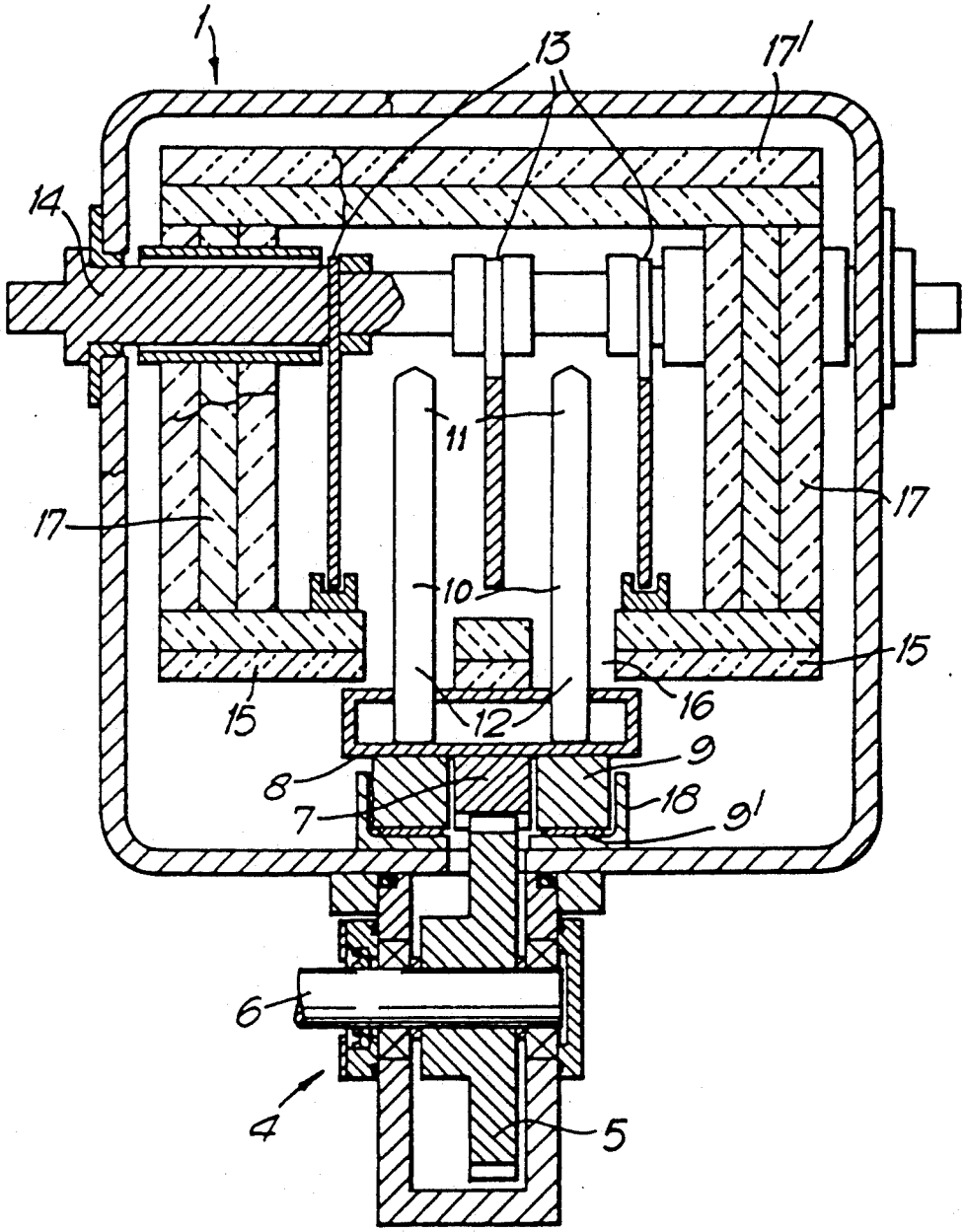
FIG. 1 is a diagramatic cross-section through a first example of a vacuum furnace.
Figure 2:
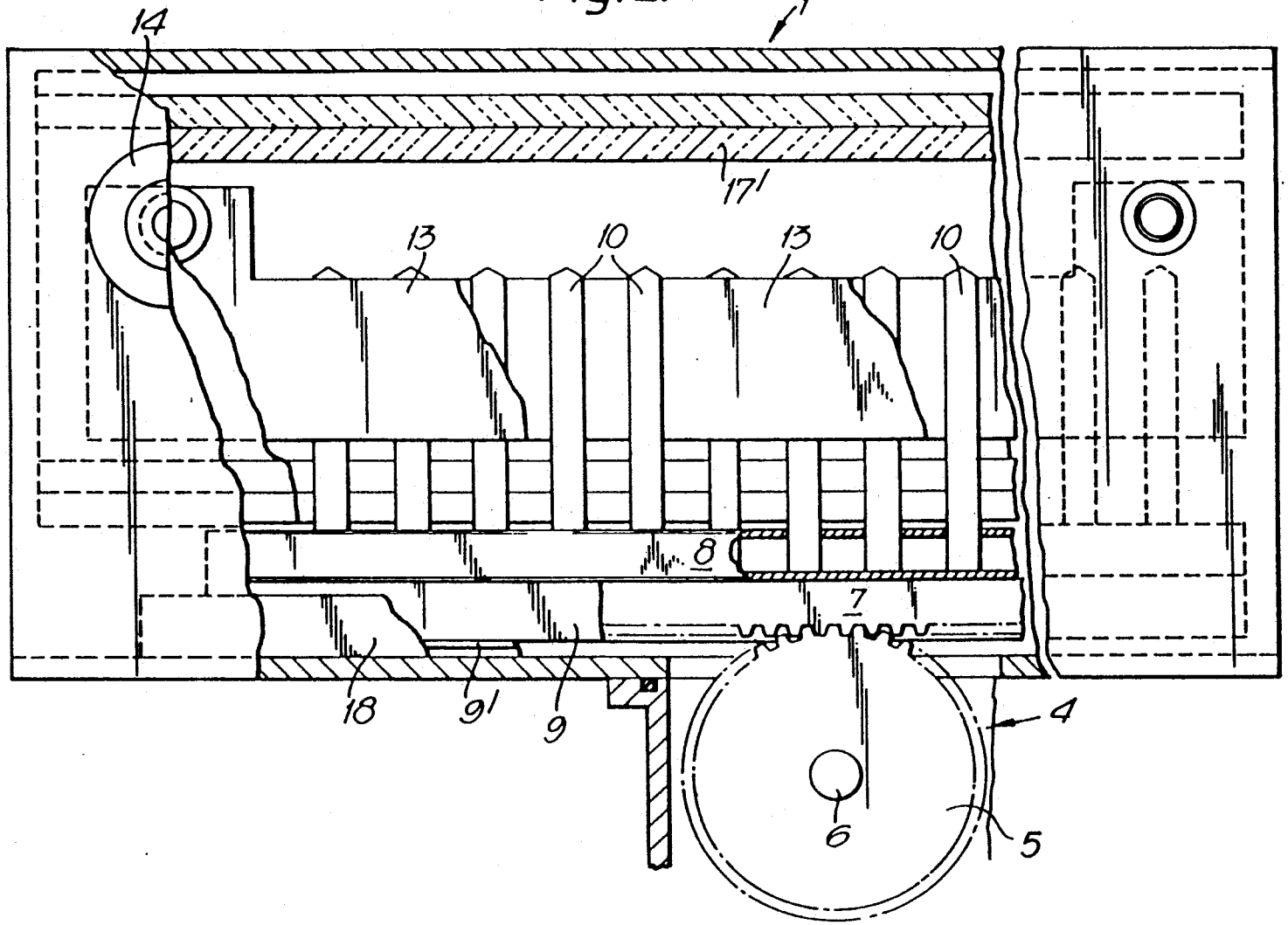
FIG. 2 is a diagramatic longitudinal section through the furnace of FIG. 1.

The furnace of the first example is shown diagrammatically in FIGS. 1 and 2 for simplicity. The furnace has an elongate, tubular form, housing 1 which comprises a pressure vessel so that the furnace can be evacuated in use. Since the evacuation of the furnace forms no part of this invention, elements relating thereto are neither described nor shown in the drawings.

The furnace has a front opening 2 and a rear opening 3 through which articles to be heat treated in the furnace can be loaded into and passed out of the furnace respectively. Air-tight doors (not shown) are provided to seal the ends of the pressure vessel. A loading chamber and a cooling chamber (not shown) may be located immediately in front of and behind the furnace respectively, communicating with the interior of the furnace through the openings 2,3.

Preferably the furnace includes a mechanism 4 by means of which plural workpieces can be loaded into the furnace and removed therefrom quickly and efficiently. In the example, this mechanism comprises a rack and pinion drive indicated schematically, the pinion 5 having a suitable drive mechanism 6 and engaging, through the wall of the furnace, a rack 7 attached to the underside of a workpiece support 8. The workpiece support is preferably formed of an insulating material and is supported on elongate graphite blocks 9 which slide on graphite cards 9' and act both as bearings and to reduce transmission of heat to the rack and pinion mechanism, the graphite blocks and cards being located in an elongate guide 18.

The workpiece support 8 is shown supporting a row of elongate metallic workpieces 10, in the present case drill bits or drill blanks, which are to be hardened in the furnace.

It is desirable for the working tip 11 of each drill bit to be hardened in the furnace, in order to fulfill its function, but it is desirable for the lower (as shown) portion 12 of each bit to be relatively softer so that it is readily engaged by the chuck in which it is to be used. In order to achieve this, the furnace of the present invention has an array of heating elements comprising three elongate belt-like sintered resistance heating elements 13 disposed parallel to the longitudinal centreline of the furnace and closely adjacent to the bits 10 in use. Each of the resistance elements 13 is supported at one end from the power feed-through 14 and the other end by an earthed support, the heating elements being disposed towards the top of the bits 10 in order to provide direct heat radiation to the tips 11 of the bits 10. In order to prevent undesirable hardening of the lower portion 12 of each bit, a thermally insulating shielding element 15 is provided on each side of the row of bits, a small gap 16 being left between them for the passage of the bit. Similar heat shielding elements 17 and 17' are disposed around the sides and top of the furnace in order to shield the pressure vessel wall from direct heat from the heating elements 13.

Figure 3:
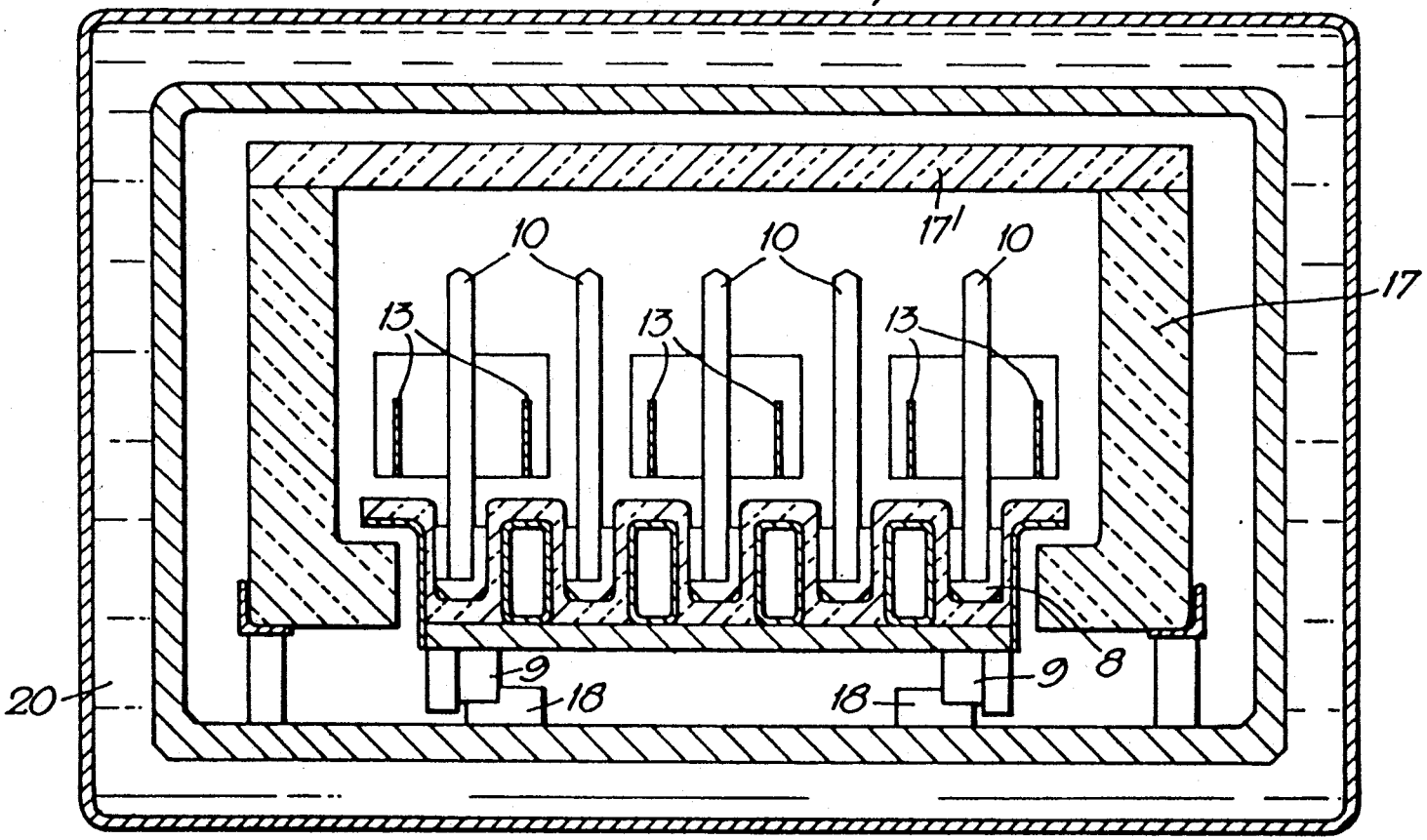
FIG. 3 is a diagrammatic cross-section of a second example of a vacuum furnace; and, FIG. 4 is a diagrammatic plan section through the furnace of FIG. 3.
Figure 4:
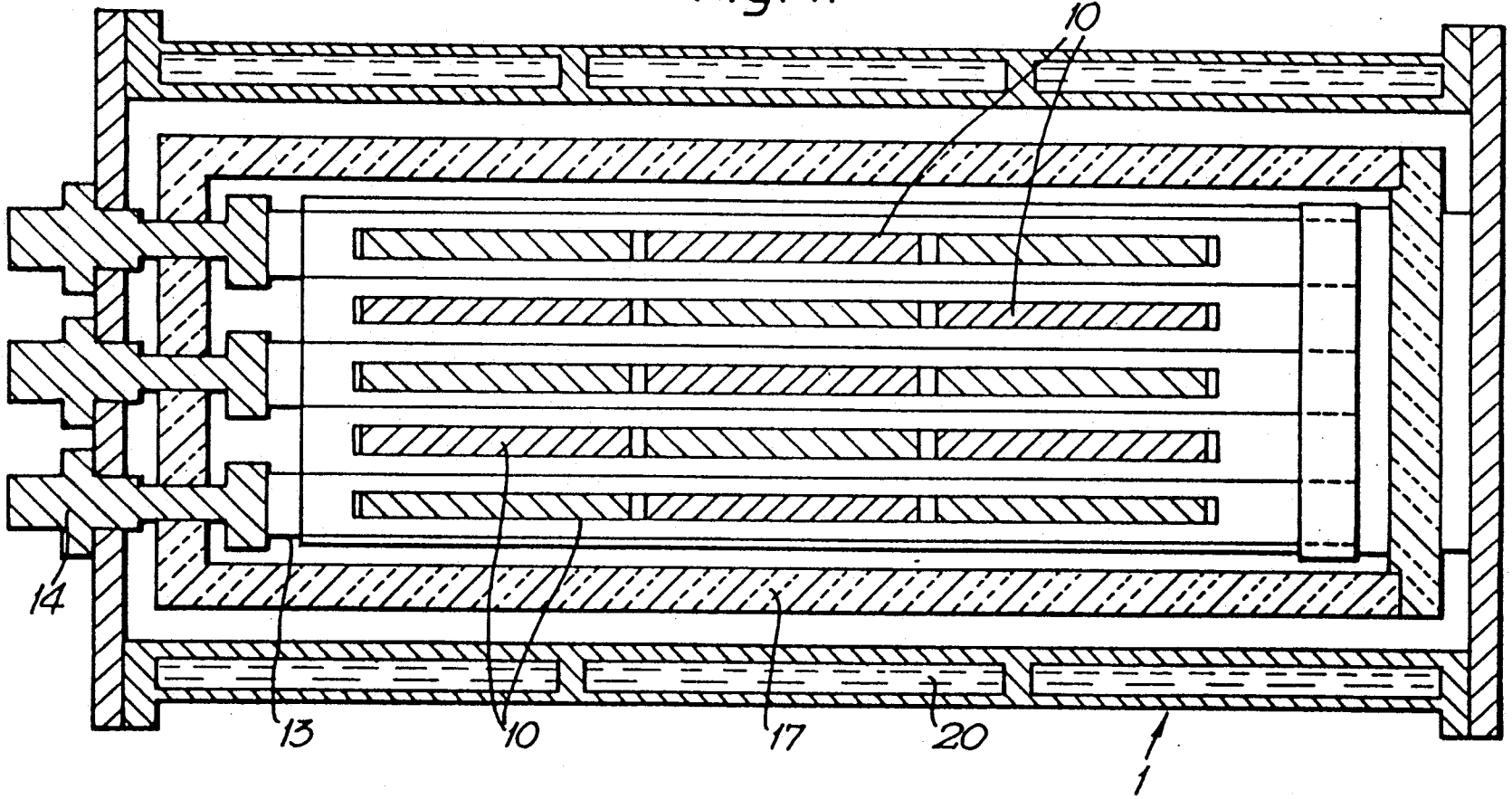

A second example of a vacuum furnace according to the present invention is shown in FIGS. 3 and 4. The same reference numerals are used for those features in FIGS. 3 and 4 which correspond to features shown in FIGS. 1 and 2.

The housing 1 has a water jacket 20 surrounding it (FIG. 3 only). As in the first example, the furnace has side 17 and top 17' heat shielding elements and a workpiece support 8 of insulating material supported on graphite blocks 9 which slide on guides 18. In the second example, six heating elements 13 are evenly distributed across the width of the furnace so that up to five rows of workpieces 10 can be accommodated as shown. Power feed-through 14 to the elements 13 in this example is from one end of the furnace.

It will readily be appreciated that intense heat can be applied, by this technique, just to those portions of workpieces which are required to be hardened, in an effective and economic fashion unknown from prior art vacuum furnaces in which the heating elements are disposed around the walls of the furnace. The example shown schematically in the drawings is merely illustrative of the concept of the invention and it should be noted that the invention contemplates, in particular, the provision of multiple electrical heating elements and heat insulating sections disposed around multiple layers of workpieces which are to be hardened or otherwise heat treated.

Since radiation efficiency is inherently high, total power consumption is reduced. In particular, the use of low voltage, high current output fed to the ends of heating elements which are centrally earthed avoids the need to utilise ceramic insulators. This reduces cost and maximises the performance of the heating elements since degradation of exposed ceramic is no longer a factor which has to be taken into consideration.

Additionally, with multiple heating elements in accordance with the present invention, power fed to the heating elements may be individually controlled and matched to the particular process requirements to provide balanced heating of the hot zone within the furnace in order to maximise uniformity.

We claim:

1. An electrically heated furnace for heat treating metallic articles comprising:

a pressure vessel housing, said housing having a longitudinal dimension;

holding means for positioning the metallic articles to be heat treated in said housing in at least a pair of rows of articles arranged parallel to the longitudinal dimension of said housing; and a plurality of heating elements in said housing, said heating elements being spaced apart in a first direction normal to the longitudinal dimension of said housing and lying parallel to said longitudinal dimension, said heating elements extending in a second direction normal to said longitudinal dimension and said first direction to have sides lying parallel to said longitudinal dimension, said heating elements being interleaved with the rows of articles positioned by said holding means, at least one of said heating elements applying radiant heat to articles from both sides of said heating element to heat treat the articles.

2. A furnace according to claim 1, wherein said heating elements comprise elongated, sintered resistance heating elements.

3. A furnace according to claim 1, wherein said heating elements comprise a plurality of plate-like heating elements, said at least one heating element having heat radiating surfaces on each side thereof, said surfaces lying parallel to said longitudinal dimension and extending in said second direction.

4. A furnace according to claim 1, wherein said heating elements are elongated in a direction parallel to the longitudinal dimension of said housing.

5. A furnace according to claim 1, further including a feed mechanism coupled to said holding means for moving said holding means and articles along the longitudinal dimension of said housing.

6. A furnace according to claim 5, wherein said feed mechanism comprises a rack and pinion mechanism.

7. A furnace according to claim 5, wherein said feed mechanism includes a plurality of graphite bearing blocks on which said holding means is arranged to slide and which reduce transmission of heat from said furnace.

8. A furnace according to claim 1 further including a plurality of shield sections adjustably disposed within said housing in thermally shielding relationship to at least selected parts of the articles being heat treated in said housing to control the heat treatment of the articles in a desired manner.

* * * * *